US011830424B2

(12) United States Patent
Zheng et al.

(10) Patent No.: US 11,830,424 B2
(45) Date of Patent: Nov. 28, 2023

(54) PIXEL CIRCUIT AND AMOLED DISPLAY PANEL HAVING SAME

(71) Applicant: SHENZHEN CHINA STAR OPTOELECTRONICS SEMICONDUCTOR DISPLAY TECHNOLOGY CO., LTD., Shenzhen (CN)

(72) Inventors: Jiexin Zheng, Shenzhen (CN); Qikun Liu, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 724 days.

(21) Appl. No.: 16/957,089

(22) PCT Filed: Apr. 23, 2020

(86) PCT No.: PCT/CN2020/086402
§ 371 (c)(1),
(2) Date: Jun. 22, 2020

(87) PCT Pub. No.: WO2021/208131
PCT Pub. Date: Oct. 21, 2021

(65) Prior Publication Data

US 2023/0124518 A1 Apr. 20, 2023

(30) Foreign Application Priority Data

Apr. 14, 2020 (CN) ..... 202010289661.6

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0842* (2013.01); *G09G 2320/0238* (2013.01); *G09G 2320/045* (2013.01)

(58) Field of Classification Search
CPC ..... G09G 3/3233; G09G 2300/0426; G09G 2300/0819; G09G 2300/0842; G09G 2320/0238; G09G 2320/045
See application file for complete search history.

(56) References Cited

U.S. PATENT DOCUMENTS

| | | | | |
|---|---|---|---|---|
| 10,490,124 | B2 * | 11/2019 | Xie | G09G 3/3225 |
| 11,062,658 | B1 * | 7/2021 | Zheng | G09G 3/3266 |
| 11,308,866 | B2 * | 4/2022 | Tian | G09G 3/3233 |
| 11,308,878 | B2 * | 4/2022 | Liu | G09G 3/3291 |

(Continued)

FOREIGN PATENT DOCUMENTS

| | | |
|---|---|---|
| CN | 107316614 A | 11/2017 |
| CN | 108597441 A | 9/2018 |
| CN | 108597448 A | 9/2018 |

*Primary Examiner* — Doon Y Chow
*Assistant Examiner* — Dennis Chow
(74) *Attorney, Agent, or Firm* — PV IP PC; Wei Te Chung; Zhigang Ma

(57) ABSTRACT

A pixel circuit is provided. The pixel circuit includes a light emitting unit, a drive unit, a switch unit connected to a first control terminal of the drive unit, a voltage maintenance unit, a potential reset unit connected to a second control terminal of the drive unit, and a potential maintenance unit.

12 Claims, 4 Drawing Sheets

(56) References Cited

U.S. PATENT DOCUMENTS

| | | | | |
|---|---|---|---|---|
| 11,417,273 | B2 * | 8/2022 | Toyotaka | G09F 9/30 |
| 2013/0063413 | A1 * | 3/2013 | Miyake | G09G 3/32 345/212 |
| 2014/0168194 | A1 * | 6/2014 | Kong | G09G 3/3283 345/212 |
| 2015/0171156 | A1 | 6/2015 | Miyake | |
| 2015/0187276 | A1 * | 7/2015 | Shim | G09G 3/3291 345/77 |
| 2016/0042694 | A1 | 2/2016 | Lim et al. | |
| 2016/0351096 | A1 * | 12/2016 | Tani | G09G 3/3233 |

* cited by examiner

PIXEL CIRCUIT AND AMOLED DISPLAY PANEL HAVING SAME

RELATED APPLICATIONS

This application is a Notional Phase of PCT Patent Application No. PCT/CN2020/086402 having international filing date of Apr. 23, 2020, which claims the benefit of priority of Chinese Patent Application No. 202010289661.6 filed on Apr. 14, 2020. The contents of the above applications are all incorporated by reference as if fully set forth herein in their entirety.

FIELD OF INVENTION

The present invention relates to the field of display technologies, and more particularly to a pixel circuit and an active-matrix organic light-emitting diode (AMOLED) display panel having the same.

BACKGROUND OF INVENTION

In the panel display industry, active-matrix organic light-emitting diode (AMOLED) displays have higher color saturation and lower energy consumption than liquid crystal display (LCD) displays and are favored by major screen manufacturers. Organic light-emitting diode (OLED) devices can be roughly divided into a vapor deposition method and an inkjet printing (IJP) method in manufacturing processes. The vapor deposition method is currently a mainstream mass production program. Considering factors such as a utilization rate of OLED material and the number of masks, major screen manufacturers began to develop inkjet printing technology. IJP OLED device preparation does not require a mask, and a material utilization rate of the printing method is much higher than the vapor deposition method.

Compared with vapor-deposited OLED devices, IJP OLED devices have fewer device stacks and lower turn-on voltage (Vth). If an OLED screen backplane is composed of a thin film transistor (TFT) using indium gallium zinc oxide (IGZO) material as a channel, a 3T1C pixel unit circuit is generally used, as shown in FIG. 1. When WR/RD gives a high-potential signal, Data signal and Sense signal reset gate signal and source signal of a thin film transistor T1, respectively. When WR/RD becomes a low-potential signal, gate-to-source voltage (Vgs) of the thin film transistor T1 indirectly determines an OLED brightness. Due to the small voltage across IJP OLED, it is about 1.8 V. When a black image is to be displayed, a negative drift of Vth of a driving TFT may easily cause Vgs to be greater than Vth, and a voltage at point S to be greater than 1.8V. At this time, the OLED device is turned on to emit light, and the screen cannot display a completely black image, which further reduces a screen contrast greatly.

SUMMARY OF INVENTION

The present application provides a pixel circuit, which solves an issue that a threshold voltage in the pixel circuit drifts when displaying a black image, which reduces a display contrast.

In a first aspect, the present application provides a pixel circuit comprising a light emitting unit connected to a negative power signal; a drive unit connected to a positive power signal and an input terminal of the light emitting unit, and configured to drive the light emitting unit; a switch unit connected to a first control terminal of the drive unit, and configure to output a data signal according to a first scan signal to control the drive unit; a voltage maintenance unit connected to the first control terminal of the drive unit and an output terminal of the drive unit, and configured to maintain a voltage difference between the first control terminal of the drive unit and the output terminal of the drive unit; a potential reset unit connected to a second control terminal of the drive unit, and configured to output a potential reset signal according to a second scan signal to reset a threshold voltage of the drive unit; and a potential maintenance unit connected to the second control terminal of the drive unit and the output terminal of the drive unit, and configured to maintain a potential difference between the second control terminal of the drive unit and the output terminal of the drive unit.

According to the first aspect, in a first embodiment of the first aspect, the pixel circuit further comprises a compensation unit. An input terminal of the compensation unit is connected to a compensation signal; a control terminal of the compensation unit is connected to the second scan signal; an output terminal of the compensation unit is connected to the voltage maintenance unit, the output terminal of the drive unit, the input terminal of the light emitting unit, and the potential maintenance unit, and configured to output the compensation signal according to the second scan signal to compensate a voltage output by the drive unit.

According to the first embodiment of the first aspect, in a second embodiment of the first aspect, the switch unit comprises a first thin film transistor; a drain of the first thin film transistor is connected to the data signal; a gate of the first thin film transistor is connected to the first scan signal.

According to the second embodiment of the first aspect, in a third embodiment of the first aspect, the drive unit comprises a double gate type second thin film transistor; a source of the first thin film transistor is connected to a top gate of the second thin film transistor; the positive power signal is connected to a drain of the second thin film transistor.

According to the third embodiment of the first aspect, in a fourth embodiment of the first aspect, the light emitting unit comprises an organic light emitting diode (OLED) device; a source of the second thin film transistor is connected to an input terminal of the OLED device; an output terminal of the OLED device is connected to the negative power signal.

According to the fourth embodiment of the first aspect, in a fifth embodiment of the first aspect, the potential maintenance unit comprises a storage capacitor; a first end of the storage capacitor is connected to the top gate of the second thin film transistor; a second end of the storage capacitor is connected to the source of the second thin film transistor.

According to the fifth embodiment of the first aspect, in a sixth embodiment of the first aspect, the potential reset unit comprises a third thin film transistor; a drain of the third thin film transistor is connected to the potential reset signal; a gate of the third thin film transistor is connected to the second scan signal; a source of the third thin film transistor is connected to a bottom gate of the second thin film transistor.

According to the sixth embodiment of the first aspect, in a seventh embodiment of the first aspect, the potential maintenance unit comprises a maintenance capacitor; a first end of the maintenance capacitor is connected to the source of the third thin film transistor and the bottom gate of the second thin film transistor; a second end of the maintenance capacitor is connected to the second end of the storage capacitor, the source of the second thin film transistor, and the input terminal of the OLED device.

According to the first embodiment of the seventh aspect, in an eighth embodiment of the first aspect, the compensation unit comprises a fourth thin film transistor; a drain of the fourth thin film transistor is connected to the compensation signal; a gate of the fourth thin film transistor is connected to the second scan signal; a source of the fourth thin film transistor is connected to the second end of the maintenance capacitor.

In a second aspect, the present application provides an AMOLED display panel comprising the pixel circuit in any of the above embodiments.

Beneficial Effect

The pixel circuit provided by the present application resets a threshold voltage of the drive unit by the potential reset unit when displaying a black image, so as to avoid the threshold voltage of the drive unit from drifting. The potential maintenance unit can further drive the potential difference between the second control terminal and the output terminal of the drive unit and maintain the threshold voltage of the drive unit from drifting for a longer time, thereby improving a display contrast.

DETAILED DESCRIPTION OF PREFERRED EMBODIMENTS

In order to make the purpose, technical solutions, and effects of the present application clearer, the present application will be described in further detail below with reference to the accompanying drawings and examples. It is understood that the specific embodiments described herein are only used to explain the present application and are not used to limit the present application.

Figure 1:
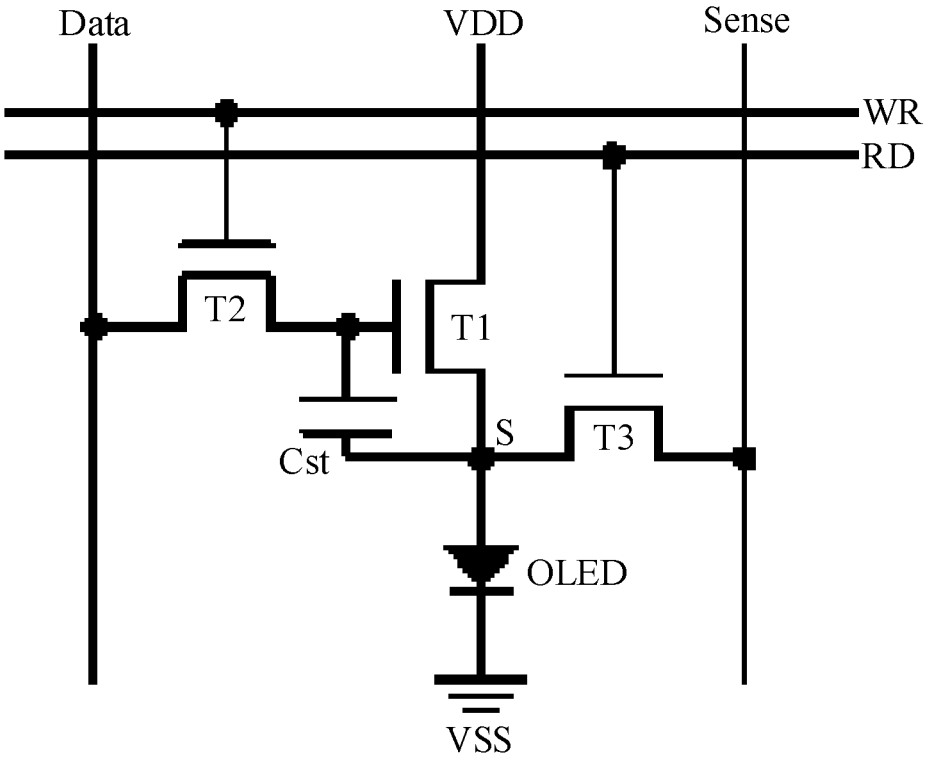
FIG. 1 (Prior Art)
FIG. 1 is a circuit schematic diagram of a pixel circuit in a conventional technical solution.

In order to better understand the invention of the present invention, the 3T1C pixel circuit in the conventional technical solution will be further introduced. As shown in FIG. 1, generally when the 3T1C circuit displays a black image, a voltage of Data is 0.2 V and a voltage of Sense is 1.2 V, then a voltage at point S is 2 V. At this time, the voltage at point S is greater than a threshold voltage Vth of an OLED (about 1.8V). After Data signal is written, WR/RD signal switches to low-potential. If the threshold voltage of a thin film transistor T1 is negatively drifted, it is −2 V, which is smaller than a voltage difference Vgs between a gate and a source of the thin film transistor T1. That is, the voltage at Data minus the voltage at point S is −1.8 V. At this time, the thin film transistor T1 and the OLED are turned on at the same time, and the OLED emits light so that the screen cannot display a pure black image normally.

Figure 3:
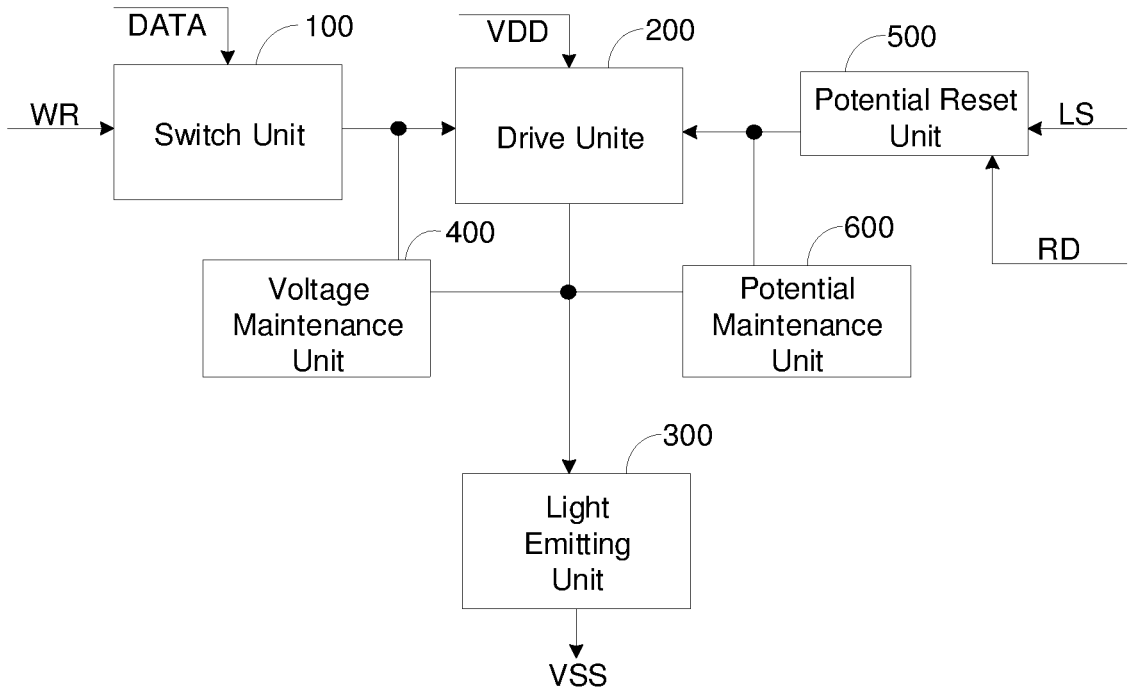
FIG. 3 is a schematic diagram of a first structure of a pixel circuit provided by an embodiment of the present application.

Based on the above issues, an embodiment of the present application provides a pixel circuit, as shown in FIG. 3. The pixel circuit comprises a light emitting unit 300, a drive unit 200, a switch unit 100, a voltage maintenance unit 400, a potential reset unit 500, and a potential maintenance unit 600. The light emitting unit 300 is connected to a negative power signal VSS. The drive unit 200 is connected to a positive power signal VDD and an input terminal of the light emitting unit 300 and configured to drive the light emitting unit 300. The switch unit 100 is connected to a first control terminal of the drive unit 200 and configure to output a data signal DATA according to a first scan signal WR to control the drive unit 200. The voltage maintenance unit 400 is connected to the first control terminal of the drive unit 200 and an output terminal of the drive unit 200 and configured to maintain a voltage difference between the first control terminal of the drive unit 200 and the output terminal of the drive unit 200. The potential reset unit 500 is connected to a second control terminal of the drive unit 200 and configured to output a potential reset signal LS according to a second scan signal RD to reset a threshold voltage of the drive unit 200. The potential maintenance unit 600 is connected to the second control terminal of the drive unit 200 and the output terminal of the drive unit 200 and configured to maintain a potential difference between the second control terminal of the drive unit 200 and the output terminal of the drive unit 200.

Specifically, when the first scan signal WR is at a high potential, the switch unit 100 is controlled to be turned on. The data signal DATA accessed by the switch unit 100 is simultaneously output to the drive unit 200 and the voltage maintenance unit 400 to control the first control terminal of the drive unit 200 so that the drive unit 200 is turned on. After the voltage maintenance unit 400 is charged and the drive unit 200 is turned on, the positive power signal VDD connected to the input terminal of the drive unit 200 will be output from the output terminal of the drive unit 200 to drive the light emitting unit 300 to emit light, that is, image display. When the first scan signal WR is at a low potential, the switch unit 100 is turned off. At the same time, the charge stored in the voltage maintenance unit 400 will maintain the drive unit 200 in the turn-on state for a period, after which the drive unit 200 will be turned off. When black image display needs to be displayed, the second scan signal RD is at a high potential, and the second scan signal RD controls the potential reset unit 500 to be turned on to output the potential reset signal LS connected to the potential reset unit 500 to the second control terminal of the drive unit 200. Furthermore, the threshold voltage of the drive unit 200 is reset. This can prevent the threshold voltage of the drive unit 200 from drifting. At the same time, the potential reset signal LS output by the potential reset unit 500 charges the potential maintenance unit 600. When the second scan signal RD is at a low potential, the potential maintenance unit 600 will continue to maintain the potential difference between the second control terminal of the drive unit 200 and its output terminal. This enables the threshold voltage of the drive unit 200 to remain drift-free for a long time, which is beneficial to further improve a display contrast. The threshold voltage of the drive unit 200 may be, but not limited to, the voltage difference between the first control terminal of the drive unit 200 and its output terminal.

Figure 4:
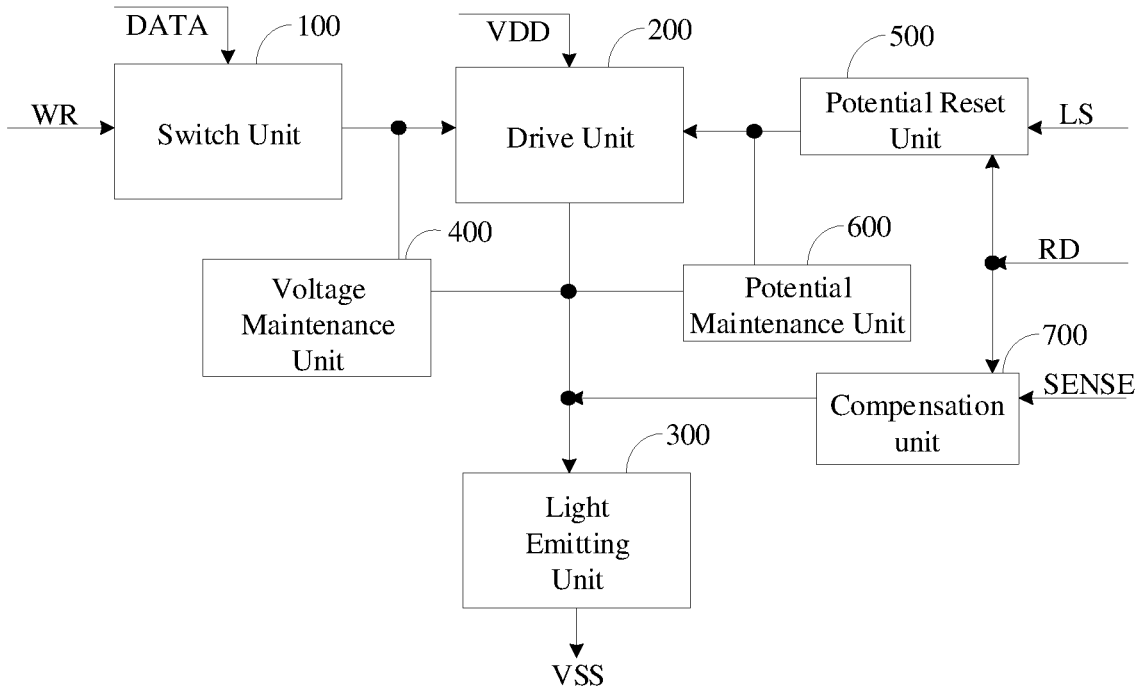
FIG. 4 is a second schematic structural diagram of a pixel circuit provided by an embodiment of the present application.

As shown in FIG. 4, in one of the embodiments, the pixel circuit further comprises a compensation unit 700. An input terminal of the compensation unit 700 is connected to a compensation signal SENSE. A control terminal of the compensation unit 700 is connected to the second scan signal RD. An output terminal of the compensation unit 700 is connected to the voltage maintenance unit 400, the output terminal of the drive unit 200, the input terminal of the light emitting unit 300, and the potential maintenance unit 600, and configured to output the compensation signal SENSE according to the second scan signal RD to compensate a voltage output by the drive unit 200.

Specifically, when the second scan signal RD is at a high potential, the second scan signal RD controls the compensation unit 700 to be in a turned-on state. The compensation signal connected to the input terminal of the compensation unit 700 is output to the output terminal of the drive unit 200 to compensate the potential of the positive power signal VDD output by the drive unit 200.

Figure 5:
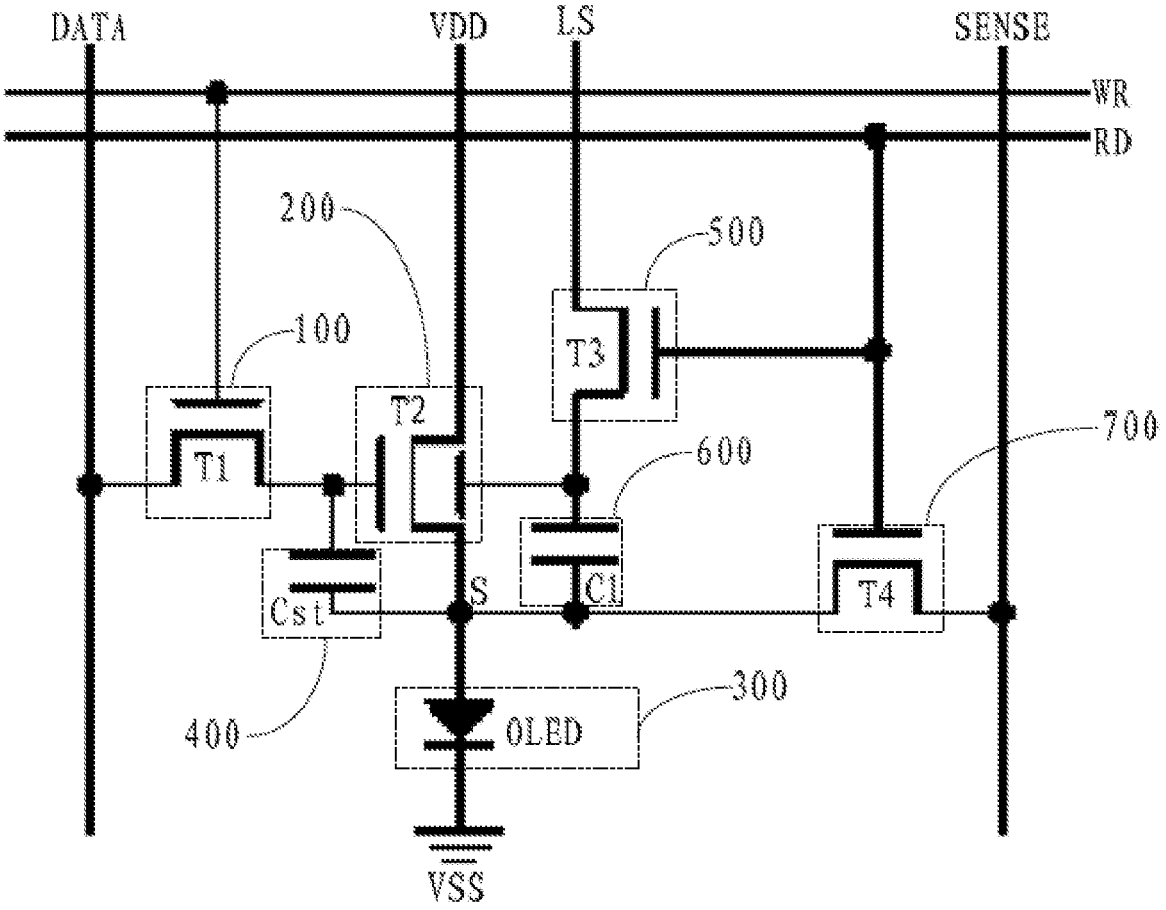
FIG. 5 is a circuit schematic diagram of the pixel circuit in FIG. 4.

As shown in FIG. 5, in one of the embodiments, the switch unit 100 comprises a first thin film transistor T1. A drain of the first thin film transistor T1 is connected to the data signal DATA, and a gate of the first thin film transistor T1 is connected to the first scan signal WR.

As shown in FIG. 5, in one of the embodiments, the drive unit 200 comprises a double gate type second thin film transistor T2. A source of the first thin film transistor T1 is connected to a top gate of the second thin film transistor T2, and the positive power signal VDD is connected to a drain of the second thin film transistor T2.

Figure 6:
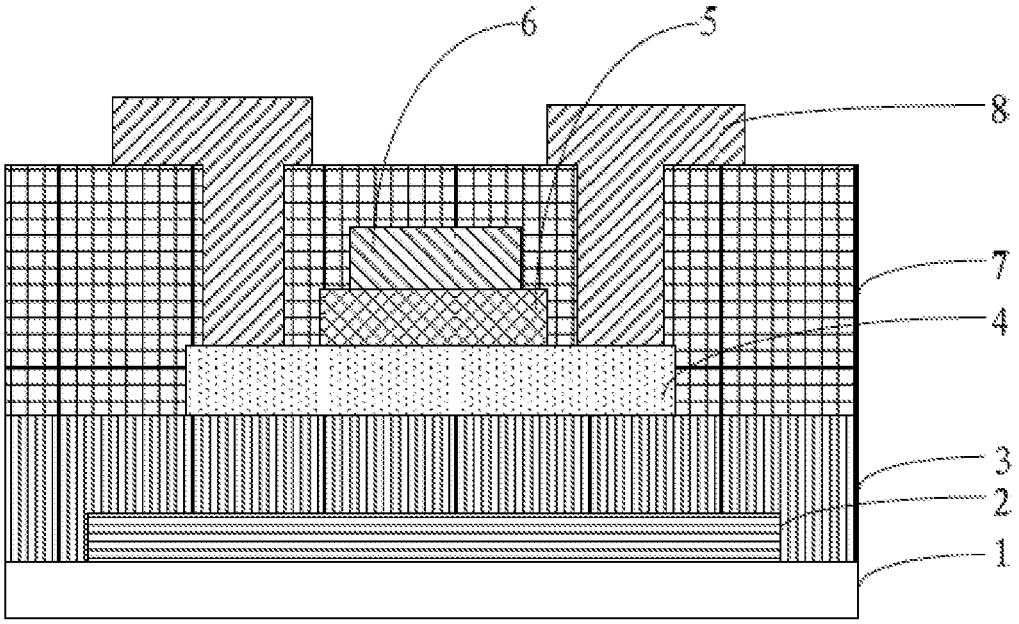
FIG. 6 is a cross-sectional structure diagram of a second thin film transistor in FIG. 5.

Specifically, in this embodiment, the drive unit 200 uses a double gate type thin film transistor. The structure of the double gate type thin film transistor is shown in FIG. 6 and includes a bottom gate metal layer 2, a buffer layer 3, an IGZO channel layer 4, a gate insulating layer 5, a gate metal layer 6, an interlayer dielectric layer 7, and a source-drain metal layer 8 that are sequentially grown on a glass substrate 1. A length of the IGZO channel layer 4 is 8 μm, and a width thereof may be, but not limited to, 20 μm, or 600 μm, or 2560 μm. The IGZO channel layer 4 has a length of 8 μm and a width of 20 μm. That is, in the W20L8 type, the threshold voltage of the double gate type thin film transistor changes with the voltage of the potential reset signal LS applied to the bottom gate metal layer 2, and the relationship between them is:

$$Vth=1.29564-0.4376*VLS \quad \text{(Equation 1)}$$

The IGZO channel layer 4 has a length of 8 μm and a width of 600 μm. That is, in the W600L8 type, the threshold voltage of the double gate type thin film transistor changes with the voltage change of the potential reset signal LS applied to the bottom gate metal layer 2, and the relationship between them is:

$$Vth=1.3688-0.4419*VLS \quad \text{(Equation 2)}$$

The IGZO channel layer 4 has a length of 8 μm and a width of 2560 μm. That is, in the W2560L8 type, the threshold voltage of the double gate type thin film transistor changes with the voltage change of the potential reset signal LS applied to the bottom gate metal layer 2, and the relationship between them is:

$$Vth=3.37416-0.4393*VLS \quad \text{(Equation 3)}$$

Vth is the threshold voltage of the double gate type thin film transistor, and VLS is a bottom gate (BG) voltage of the double gate type thin film transistor or the voltage of the potential reset signal LS.

Figure 2:
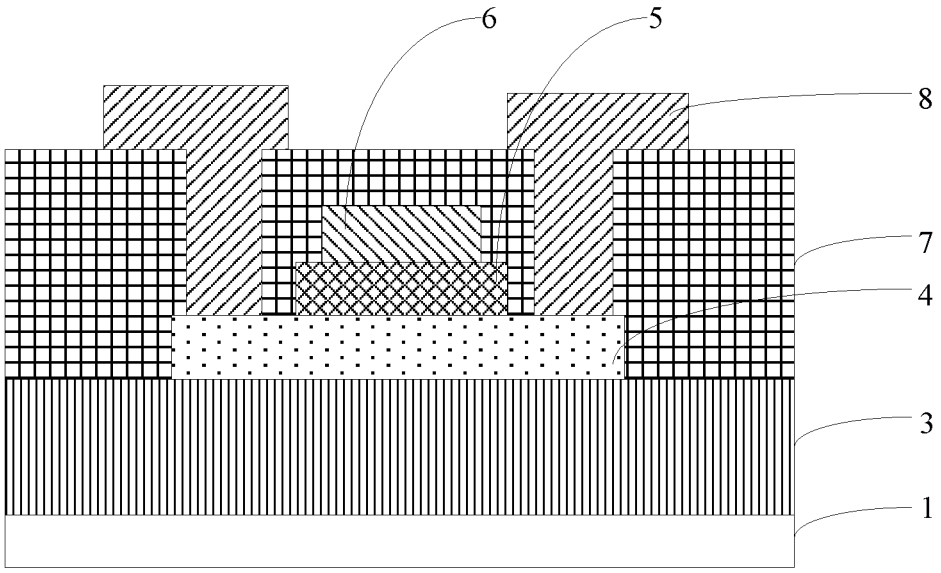
FIG. 2 (Prior Art)
FIG. 2 is a cross-sectional structure diagram of a thin film transistor T1 shown in FIG. 1.

As shown in FIG. 6, compared with the top gate type indium gallium zinc oxide three-terminal thin film transistor shown in FIG. 2, the double gate type thin film transistor used in this embodiment adds a bottom gate metal layer 2 on the glass substrate 1, thereby forming a double-gate thin film transistor, that is, a four-terminal device. When the four-terminal device operates, a top gate (TG), a source, and a drain thereof can operate properly, and a bottom gate (BG) thereof mainly plays the role of adjusting its threshold voltage and increasing or decreasing on/off current.

Figure 7:
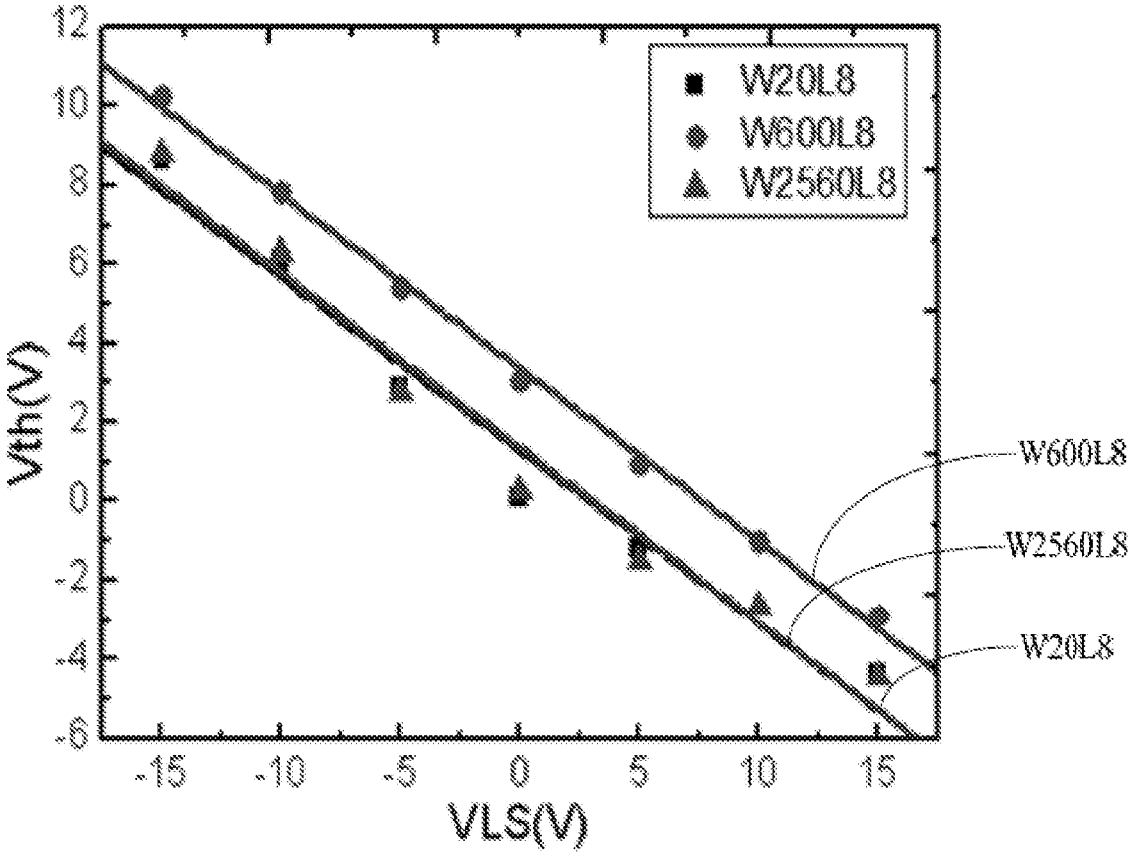
FIG. 7 is a schematic diagram of a threshold voltage of the second thin film transistor in FIG. 6 changing with its bottom gate voltage.

Combining the above three equations and shown in FIG. 7, when the voltage of the potential reset signal LS (or its bottom gate BG) is positive, the threshold voltage Vth of the double gate type thin film transistor will drift negatively. When the voltage of the potential reset signal LS (or its bottom gate BG) is negative, the threshold voltage Vth of the double gate type thin film transistor will drift positively.

As shown in FIG. 5, in one of the embodiments, the light emitting unit 300 comprises an organic light emitting diode (OLED) device. A source of the second thin film transistor T2 is connected to an input terminal of the OLED device, and an output terminal of the OLED device is connected to the negative power signal VSS.

As shown in FIG. 5, in one of the embodiments, the potential maintenance unit comprises a storage capacitor Cst. A first end of the storage capacitor Cst is connected to the top gate of the second thin film transistor T2, and a second end of the storage capacitor Cst is connected to the source of the second thin film transistor T2.

As shown in FIG. 5, in one of the embodiments, the potential reset unit 500 comprises a third thin film transistor T3. A drain of the third thin film transistor T3 is connected to the potential reset signal LS, a gate of the third thin film transistor T3 is connected to the second scan signal RD, and a source of the third thin film transistor T3 is connected to a bottom gate of the second thin film transistor T2.

As shown in FIG. 5, in one of the embodiments, the potential maintenance unit 600 comprises a maintenance capacitor C1. A first end of the maintenance capacitor C1 is connected to the source of the third thin film transistor T3 and the bottom gate of the second thin film transistor T2, and a second end of the maintenance capacitor C1 is connected to the second end of the storage capacitor Cst, the source of the second thin film transistor T2, and the input terminal of the OLED device.

As shown in FIG. 5, in one of the embodiments, the compensation unit 700 comprises a fourth thin film transistor T4. A drain of the fourth thin film transistor T4 is connected to the compensation signal SENSE, a gate of the fourth thin film transistor T4 is connected to the second scan signal RD, and a source of the fourth thin film transistor T4 is connected to the second end of the maintenance capacitor C1.

The working principle of the pixel circuit in FIG. 5:

In the signal writing stage, that is, when the first scan signal WR and/or the second scan signal RD are both at a high potential, the data signal DATA is written to the top gate of the second thin film transistor T2 through the first thin film transistor T1. The compensation signal SENSE is written to the source of the second thin film transistor T2 through the fourth thin film transistor T4. The potential reset signal LS is written to the bottom gate of the second thin film transistor T2 through the third thin film transistor T3. In this process, due to the voltage division of the second thin film transistor T2 and the fourth thin film transistor T4, the voltage at the source of the second thin film transistor T2, that is, point S, will be slightly greater than the voltage of the compensation signal SENSE.

During signal writing, the bottom gate of the second thin film transistor T2 is written with a negative bias voltage, so that the threshold voltage Vth of the second thin film transistor T2 is positively drifted. This makes the threshold voltage Vth of the second thin film transistor T2 greater than −1.8 V after the first scan signal WR and/or the second scan signal RD is switched to a low-potential signal. Therefore, the second thin film transistor T2 is pinched off, so that no current is passed through the OLED device, electroluminescence cannot be achieved, and then the pure black image display of the screen is realized.

The function of the maintenance capacitor C1 is to maintain the voltage difference between the bottom gate and the source of the second thin film transistor T2 after writing of the potential reset signal LS is completed. This prevents the threshold voltage Vth of the second thin film transistor T2 from drifting. The function of the third thin film transistor T3 is to reset the bottom gate voltage of the second thin film transistor T2 during the signal writing stage.

In one of the embodiments, the present application provides an AMOLED display panel, which includes the pixel circuit in any of the above embodiments. The pixel circuits can be arranged in an array in an AMOLED display panel, but not limited to. The AMOLED display panel may include, but is not limited to, at least one pixel circuit provided in this embodiment. Since the AMOLED display panel includes the pixel circuit, the pixel circuit has a technical effect, and the AMOLED display panel also have the same technical effect as the pixel circuit.

It can be understood that, for those of ordinary skill in the art, equivalent replacements or changes can be made according to the technical solutions and inventive concepts of the present application, and all such changes or replacements should fall within the protection scope of the claims appended to the present application.

What is claimed is:

1. A pixel circuit, comprising:

a light emitting unit connected to a negative power signal;

a drive unit connected to a positive power signal and an input terminal of the light emitting unit, and configured to drive the light emitting unit;

a switch unit connected to a first control terminal of the drive unit, and configure to output a data signal according to a first scan signal to control the drive unit;

a voltage maintenance unit connected to the first control terminal of the drive unit and an output terminal of the drive unit, and configured to maintain a voltage difference between the first control terminal of the drive unit and the output terminal of the drive unit;

a potential reset unit connected to a second control terminal of the drive unit, and configured to output a potential reset signal according to a second scan signal to reset a threshold voltage of the drive unit; and a potential maintenance unit connected to the second control terminal of the drive unit and the output terminal of the drive unit, and configured to maintain a potential difference between the second control terminal of the drive unit and the output terminal of the drive unit; the pixel circuit further comprising a compensation unit;

wherein an input terminal of the compensation unit is connected to a compensation signal; a control terminal of the compensation unit is connected to the second scan signal; an output terminal of the compensation unit is connected to the voltage maintenance unit, the output terminal of the drive unit, the input terminal of the light emitting unit, and the potential maintenance unit, and configured to output the compensation signal according to the second scan signal to compensate a voltage output by the drive unit;

the switch unit comprises a first thin film transistor;

a drain of the first thin film transistor is connected to the data signal; a gate of the first thin film transistor is connected to the first scan signal;

wherein the drive unit comprises a double gate type second thin film transistor;

a source of the first thin film transistor is connected to a top gate of the second thin film transistor; the positive power signal is connected to a drain of the second thin film transistor;

wherein the double gate type second thin film transistor comprises a bottom gate metal layer, a buffer layer, an IGZO channel layer, a gate insulating layer, a gate metal layer, an interlayer dielectric layer, and a source-drain metal layer sequentially disposed on a glass substrate of the pixel circuit, and a length of the IGZO channel layer of the double gate type second thin film transistor is 8 μm, and a width of the IGZO channel layer is 20 μm, 600 μm, or 2560 μm.

2. The pixel circuit according to claim 1, wherein the light emitting unit comprises an organic light emitting diode (OLED) device;

a source of the second thin film transistor is connected to an input terminal of the OLED device; an output terminal of the OLED device is connected to the negative power signal.

3. The pixel circuit according to claim 2, wherein the voltage maintenance unit comprises a storage capacitor;

a first end of the storage capacitor is connected to the top gate of the second thin film transistor; a second end of the storage capacitor is connected to the source of the second thin film transistor.

4. The pixel circuit according to claim 3, wherein the potential reset unit comprises a third thin film transistor;

a drain of the third thin film transistor is connected to the potential reset signal; a gate of the third thin film transistor is connected to the second scan signal; a source of the third thin film transistor is connected to a bottom gate of the second thin film transistor.

5. The pixel circuit according to claim 4, wherein the potential maintenance unit comprises a maintenance capacitor;

a first end of the maintenance capacitor is connected to the source of the third thin film transistor and the bottom gate of the second thin film transistor; a second end of the maintenance capacitor is connected to the second end of the storage capacitor, the source of the second thin film transistor, and the input terminal of the OLED device.

6. The pixel circuit according to claim 5, wherein the compensation unit comprises a fourth thin film transistor;

a drain of the fourth thin film transistor is connected to the compensation signal; a gate of the fourth thin film transistor is connected to the second scan signal; a source of the fourth thin film transistor is connected to the second end of the maintenance capacitor.

7. An active-matrix organic light-emitting diode (AMOLED) display panel, comprising the pixel circuit according to claim 1.

8. A pixel circuit, comprising:

a light emitting unit connected to a negative power signal;

a drive unit connected to a positive power signal and an input terminal of the light emitting unit, and configured to drive the light emitting unit;

a switch unit connected to a first control terminal of the drive unit, and configure to output a data signal according to a first scan signal to control the drive unit;

a voltage maintenance unit connected to the first control terminal of the drive unit and an output terminal of the drive unit, and configured to maintain a voltage difference between the first control terminal of the drive unit and the output terminal of the drive unit;

a potential reset unit connected to a second control terminal of the drive unit, and configured to output a potential reset signal according to a second scan signal to reset a threshold voltage of the drive unit; and a potential maintenance unit connected to the second control terminal of the drive unit and the output terminal of the drive unit, and configured to maintain a potential difference between the second control terminal of the drive unit and the output terminal of the drive unit;

wherein the switch unit comprises a first thin film transistor;

a drain of the first thin film transistor is connected to the data signal; a gate of the first thin film transistor is connected to the first scan signal;

wherein the drive unit comprises a double gate type second thin film transistor;

a source of the first thin film transistor is connected to a top gate of the second thin film transistor; the positive power signal is connected to a drain of the second thin film transistor;

wherein the double gate type second thin film transistor comprises a bottom gate metal layer, a buffer layer, an IGZO channel layer, a gate insulating layer, a gate metal layer, an interlayer dielectric layer, and a source-drain metal layer sequentially disposed on a glass substrate of the pixel circuit, and a length of the IGZO channel layer of the double gate type second thin film transistor is 8 μm, and a width of the IGZO channel layer is 20 μm, 600 μm, or 2560 μm.

9. The pixel circuit according to claim 8, wherein the light emitting unit comprises an organic light emitting diode (OLED) device;

a source of the second thin film transistor is connected to an input terminal of the OLED device; an output terminal of the OLED device is connected to the negative power signal.

10. The pixel circuit according to claim 9, wherein the voltage maintenance unit comprises a storage capacitor;

a first end of the storage capacitor is connected to the top gate of the second thin film transistor; a second end of the storage capacitor is connected to the source of the second thin film transistor.

11. The pixel circuit according to claim 10, wherein the potential reset unit comprises a third thin film transistor;

a drain of the third thin film transistor is connected to the potential reset signal; a gate of the third thin film transistor is connected to the second scan signal; a source of the third thin film transistor is connected to a bottom gate of the second thin film transistor.

12. The pixel circuit according to claim 11, wherein the potential maintenance unit comprises a maintenance capacitor;

a first end of the maintenance capacitor is connected to the source of the third thin film transistor and the bottom gate of the second thin film transistor; a second end of the maintenance capacitor is connected to the second end of the storage capacitor, the source of the second thin film transistor, and the input terminal of the OLED device.

* * * * *